US011014398B2

(12) United States Patent
Shih

(10) Patent No.: US 11,014,398 B2
(45) Date of Patent: May 25, 2021

(54) EMBOSSING SEAL

(71) Applicant: SUN SAME ENTERPRISES CO., LTD., Tainan (TW)

(72) Inventor: Wen-Jer Shih, Tainan (TW)

(73) Assignee: SUN SAME ENTERPRISES CO., LTD., Tainan (TW)

( * ) Notice: Subject to any disclaimer, the term of this patent is extended or adjusted under 35 U.S.C. 154(b) by 153 days.

(21) Appl. No.: 16/557,375

(22) Filed: Aug. 30, 2019

(65) Prior Publication Data

US 2021/0016561 A1 Jan. 21, 2021

(30) Foreign Application Priority Data

Jul. 18, 2019 (TW) ..... 108209384

(51) Int. Cl.

| | |
|---|---|
| ***B44B 5/00*** | (2006.01) |
| ***B31F 1/07*** | (2006.01) |
| ***B41F 19/06*** | (2006.01) |
| *B41K 3/36* | (2006.01) |

(52) U.S. Cl.

CPC ..... *B44B 5/0023* (2013.01); *B31F 1/07* (2013.01); *B41F 19/066* (2013.01); *B44B 5/0052* (2013.01); *B31F 2201/0705* (2013.01); *B41K 3/36* (2013.01); *B44B 5/0085* (2013.01)

(58) Field of Classification Search

None

See application file for complete search history.

(56) References Cited

U.S. PATENT DOCUMENTS

| | | | | |
|---|---|---|---|---|
| 286,496 | A * | 10/1883 | Smith | B44B 5/0085 101/31.1 |
| 424,502 | A * | 4/1890 | Rogers, Jr. | B44B 5/0085 101/31.1 |
| 1,572,046 | A * | 2/1926 | Seiler | B44B 5/0085 30/367 |
| 2,319,796 | A * | 5/1943 | Cooper | B44B 5/0052 101/4 |
| 9,718,293 | B1 * | 8/2017 | Shih | B44B 5/0038 |

* cited by examiner

*Primary Examiner* — Jill E Culler

(74) *Attorney, Agent, or Firm* — R. Lynette Wylie; Apex Juris, pllc.

(57) ABSTRACT

An embossing seal has a base, a die assembly disposed in the base, a driven shaft assembly movably disposed in the base, and a pressing handle pivotally disposed on the base for driving the driven shaft assembly. The driven shaft assembly has a lower shaft, an upper shaft, a cushion spring, and a restoring spring. The lower shaft is movably disposed in a shaft tube of the base. The upper shaft is movably disposed in the lower shaft. The cushion spring and the restoring spring are coaxially disposed around the upper shaft. Two ends of the cushion spring respectively abut against the upper shaft and the lower shaft. Two ends of the restoring spring respectively abut against the upper shaft and the shaft tube. Structure of the base and structure of the driven shaft assembly are simplified. The embossing seal is restored accurately and quickly.

20 Claims, 13 Drawing Sheets

EMBOSSING SEAL

This application claims the benefit of Taiwan patent application No. 108209384, filed on Jul. 18, 2019, the entire disclosure of which is incorporated herein by reference.

BACKGROUND OF THE INVENTION

1. Field of the Invention

The present invention relates to an embossing seal, and more particularly to an embossing seal that allows a user to hold and to form embossed patterns conveniently.

2. Description of Related Art

When a conventional embossing seal is in use, a driving mechanism of the conventional embossing seal is directly pressed to emboss in a single embossing step. The conventional embossing seal causes discomfort to a wrist and an elbow of a user. Thus, another conventional embossing seal can provide two embossing steps for increasing comfort in use.

With reference to FIGS. 11 to 13, the conventional embossing seal with two embossing steps has a base 50, a die assembly 60, a driven shaft assembly 70, a restoring assembly 80, and a pressing handle 90. The die assembly 60 is disposed in an embossing space 500 of the base 50. The driven shaft assembly 70 and the restoring assembly 80 are disposed in an operating portion 51 located above the embossing space 500. The pressing handle 90 is pivotally disposed on a top end of the operating portion 51. The driven shaft assembly 70 has a lower shaft 71. The lower shaft 71 is moveably inserted into an inner hole 52 of the operating portion 51. A bottom end of the lower shaft 71 is connected to an upper die 62 of the die assembly 60. An upper shaft 72 is moveably inserted into the lower shaft 71. A top end of the upper shaft 72 is connected to a cam portion 91 of the pressing handle 90. A top section of the upper shaft 72 protrudes out of a top end of the lower shaft 71. A cushion spring 73 is disposed around the top section of the upper shaft 72. A bottom end of the cushion spring 73 abuts against the top end of the lower shaft 71. An active end 721 formed on the top end of the upper shaft 72 is connected to the cam portion 91 of the pressing handle 90. The restoring assembly 80 has a restoring spring 82 and a linkage plate 81. The restoring spring 82 is located out of and is parallel to the lower shaft 71. A bottom portion of the restoring spring 82 is positioned on the operating portion 51. An end portion of the linkage plate 81 is disposed around a top section of the upper shaft 72 and is located below the active end 721. A top end of the cushion spring 73 abuts against a bottom surface of the end portion of the linkage plate 81. Another end portion of the linkage plate 81 is laterally inserted into the operating portion 51 of the base 50 and is connected to a top end of the restoring spring 82.

The upper shaft 72 and the lower shaft 71 of the driven shaft assembly 70 are disposed axially and movably relative to each other. The cushion spring 73 is disposed between the upper shaft 72 and the lower shaft 71 for providing two embossing steps. When the pressing handle 90 is pressed for applying a pressing force to the driven shaft assembly 70, the driven shaft assembly 70 is in a first embossing step. The upper shaft 72, the cushion spring 73, and the lower shaft 71 all move downwardly until the lower shaft 71 abuts the upper die 62 of the die assembly 60. In a second embossing step, the pressing force applied by the pressing handle 90 acts on the upper die 62 by the upper shaft 72, the cushion spring 73, and the lower shaft 71. The upper die 62 is pressed by the lower shaft 71. A die block 63 disposed on the upper die 62 forms embossed patterns on a material. The user can operate the conventional embossing seal with the two embossing steps in a comfortable and labor-saving manner for reducing the discomfort of the wrist and the elbow.

However, the conventional embossing seal with the two embossing steps has the following problems in use:

1. The base 50 is damaged easily: the driven shaft assembly 70 assisted by the restoring assembly 80 can upwardly push the pressing handle 90 for restoring the pressing handle 90. The restoring spring 82 and the lower shaft 71 are parallel to each other at a spaced interval. The linkage plate 81 pushed by the restoring spring 82 is connected to the upper shaft 72. The operating portion 51 is made of plastic and has a supporting wall 54. The supporting wall 54 is formed on the operating portion 51 for retaining the restoring spring 82. After the restoring spring 82 is repeatedly pressed by the pressing handle 90, the supporting wall 54 is easily broken and the base 50 is damaged.

2. The linkage plate 81 is easy to skew in a restoring action and the restoring operation is difficult to control accurately: the driven shaft assembly 70 assisted by the restoring assembly 80 can upwardly push the pressing handle 90 for restoring the pressing handle 90. The restoring spring 82 and the lower shaft 71 are parallel to each other at a spaced interval. The linkage plate 81 pushed by the restoring spring 82 is connected to the upper shaft 72. When the pressing force is released, the linkage plate 81 is upwardly pushed by the restoring spring 82 and drives the upper shaft 72 and the lower shaft 71 to move upwardly. The linkage plate 81 is easy to skew in the restoring action by indirect driving. It is difficult to accurately control the upper shaft 72 and the lower shaft 71 to move upwardly.

3. Many components and complex structure: the driven shaft assembly 70 assisted by the restoring assembly 80 can upwardly push the pressing handle 90 for restoring the pressing handle 90. The restoring spring 82 and the lower shaft 71 are parallel to each other at a spaced interval. The linkage plate 81 pushed by the restoring spring 82 is connected to the upper shaft 72. The amount of the components of the driven shaft assembly 70 and the components of the restoring assembly 80 are large. In addition, the base 51 has the supporting wall 54 for disposing the restoring spring 82. The structure of the conventional embossing seal is complex.

To overcome the shortcomings, the present invention provides an embossing seal to mitigate or obviate the aforementioned problems.

SUMMARY OF THE INVENTION

The objective of the invention is to provide an embossing seal that can solve the shortcomings that the conventional embossing seal is damaged easily, the structure of the conventional embossing seal is complex, and the linkage plate is easy to skew in the restoring action.

The embossing seal has a base, a die assembly, a driven shaft assembly, and a pressing handle.

The base has a carrying member, an embossing space, and an operating member. The carrying member has a carrying platform formed on the carrying member. The embossing space is formed on the base and is located above the carrying platform. The operating member is formed on the carrying member and has a shaft tube. The shaft tube is formed on the operating member, and has a shaft hole formed through the shaft tube and communicating with the embossing space of the base. The embossing space of the base is located between the shaft tube and the carrying member.

The die assembly is disposed in the base, and has a lower die, an upper die, and an elastic part. The lower die is disposed on the carrying platform and is located in the embossing space of the base. The upper die is located in the embossing space of the base and faces the lower die. The elastic part is connected to the lower die and the upper die.

The driven shaft assembly is movably disposed in the operating member of the base, and has a lower shaft, an upper shaft, a cushion spring, and a restoring spring. The lower shaft is disposed in the shaft hole of the shaft tube, is moveable up and down relative to the base, and has a top end and a central hole formed through the lower shaft. The upper shaft is disposed in the central hole of the lower shaft, is moveable up and down relative to the lower shaft, and has a top end and an active end portion. The top end of the upper shaft is protruded out of the top end of the lower shaft. The active end portion is formed on the top end of the upper shaft. The cushion spring is disposed around the upper shaft and has two ends respectively abutting against the active end portion of the upper shaft and the top end of the lower shaft. The restoring spring is disposed around the upper shaft, is located around the cushion spring, and has two ends respectively abutting against the active end portion of the upper shaft and the top end of the shaft tube. The driven shaft assembly is able to drive the upper die to move relative to the lower die.

The pressing handle is pivotally disposed on the operating member of the base, and has a bottom end and a pushing portion. The bottom end of the pressing handle is adjacent to the shaft tube. The pushing portion is formed adjacent to the bottom end of the pressing handle and abuts against the active end portion of the upper shaft.

The embossing seal in accordance with the present invention has the following advantages.

1. Simple structure: the lower shaft of the driven shaft assembly is moveable up and down relative to the base, is inserted into the shaft tube of the base, and abuts against the upper die of the die assembly. The upper shaft is inserted into the lower shaft and is moveable up and down relative to the lower shaft. The pushing portion of the pressing handle abuts against the active end portion of the upper shaft. The cushion spring is disposed between the active end portion of the upper shaft and the top end of the lower shaft. The restoring spring is disposed between the active end portion of the upper shaft and the top end of the shaft tube. The cushion spring and the restoring spring are coaxial and the restoring spring is located around the cushion spring. Structure of the base and structure of the driven shaft assembly connected between the pressing handle and the die assembly are simplified.

2. To avoid damage to the base: the restoring spring of the driven shaft assembly is disposed between the active end portion of the upper shaft and the top end of the shaft tube. The cushion spring and the restoring spring are coaxial and the restoring spring is located around the cushion spring. In use, the force of the pressing handle is directly forced on the die assembly by the driven shaft assembly for reducing the damage of the base.

3. A restoring action of the embossing seal is accurate and quick: the cushion spring is disposed between the active end portion of the upper shaft and the top end of the lower shaft. The restoring spring is disposed between the active end portion of the upper shaft and the top end of the shaft tube. The cushion spring and the restoring spring are coaxial and the restoring spring is located around the cushion spring. When the force exerted on the pressing handle is released, the driven shaft assembly can directly push the upper shaft to move upwardly by the restoring spring, and the pressing handle is rotated to restore. Therefore, the restoring action of the embossing seal is accurate and quick.

4. Comfortable and labor-saving operation: the driven shaft of the embossing seal can provide two embossing steps in a comfortable and labor-saving manner for reducing the discomfort of the wrist and the elbow of the user.

Furthermore, the carrying member has a bottom plate disposed below the carrying platform. The carrying platform has a bottom surface and a supporting rod. The supporting rod is formed on the bottom surface of the carrying platform, is located below the shaft hole of the shaft tube, and extends downwardly to be connected to the bottom plate. The carrying platform is assisted in supporting for increasing strength of the carrying platform.

Furthermore, the base has a shell and a rigid seat fixedly disposed in the shell. A bottom plate of the rigid seat abuts against the supporting rod for enhancing a supporting performance of the embossing seal.

Furthermore, the pushing portion is a rotatable roller and is rotatably connected to the active end portion of the upper shaft for avoiding deformation of the pushing portion. The active end portion of the upper shaft is evenly forced by the pushing portion.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
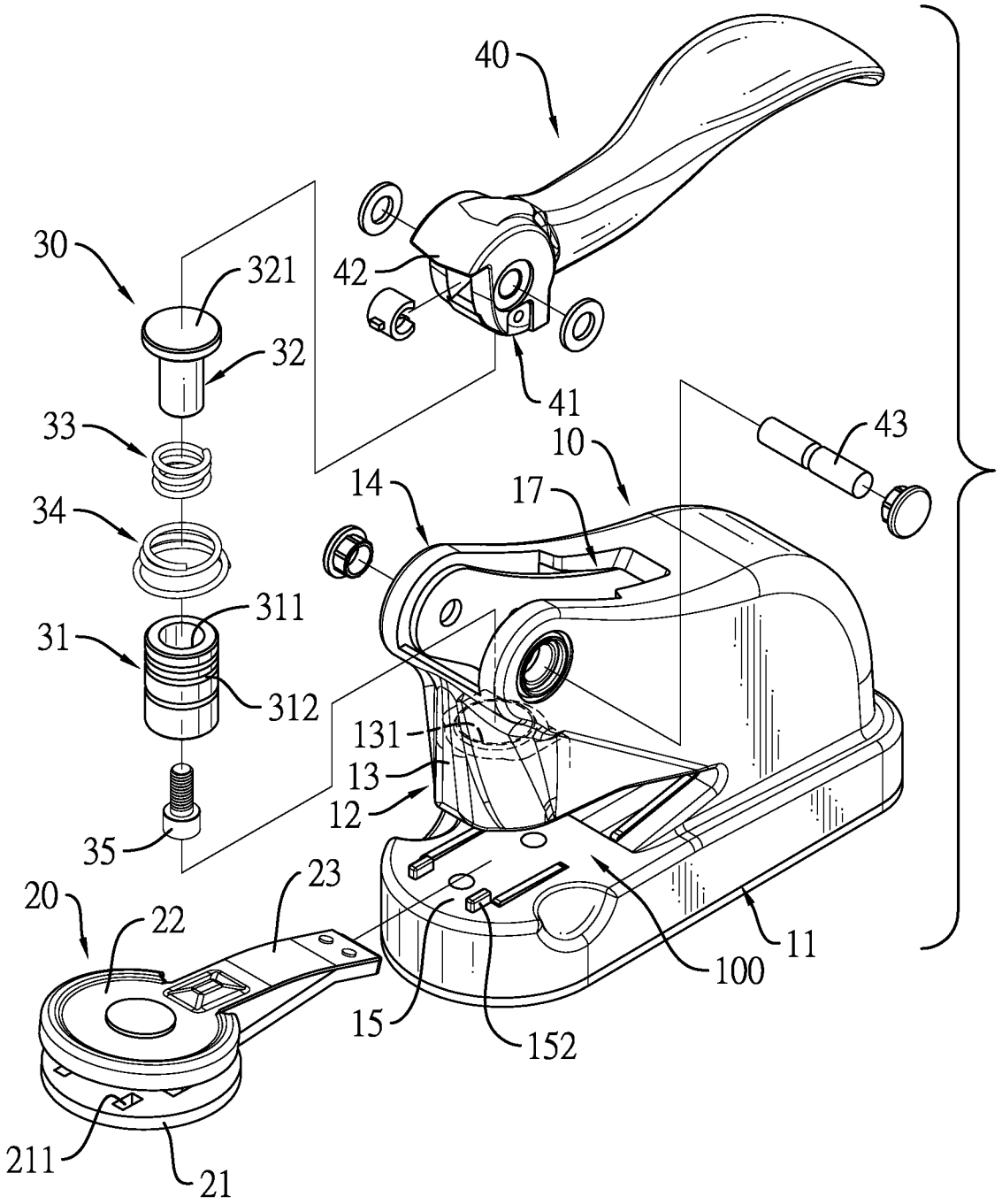
FIG. 1 is an exploded perspective view of a first embodiment of an embossing seal in accordance with the present invention.
Figure 2:
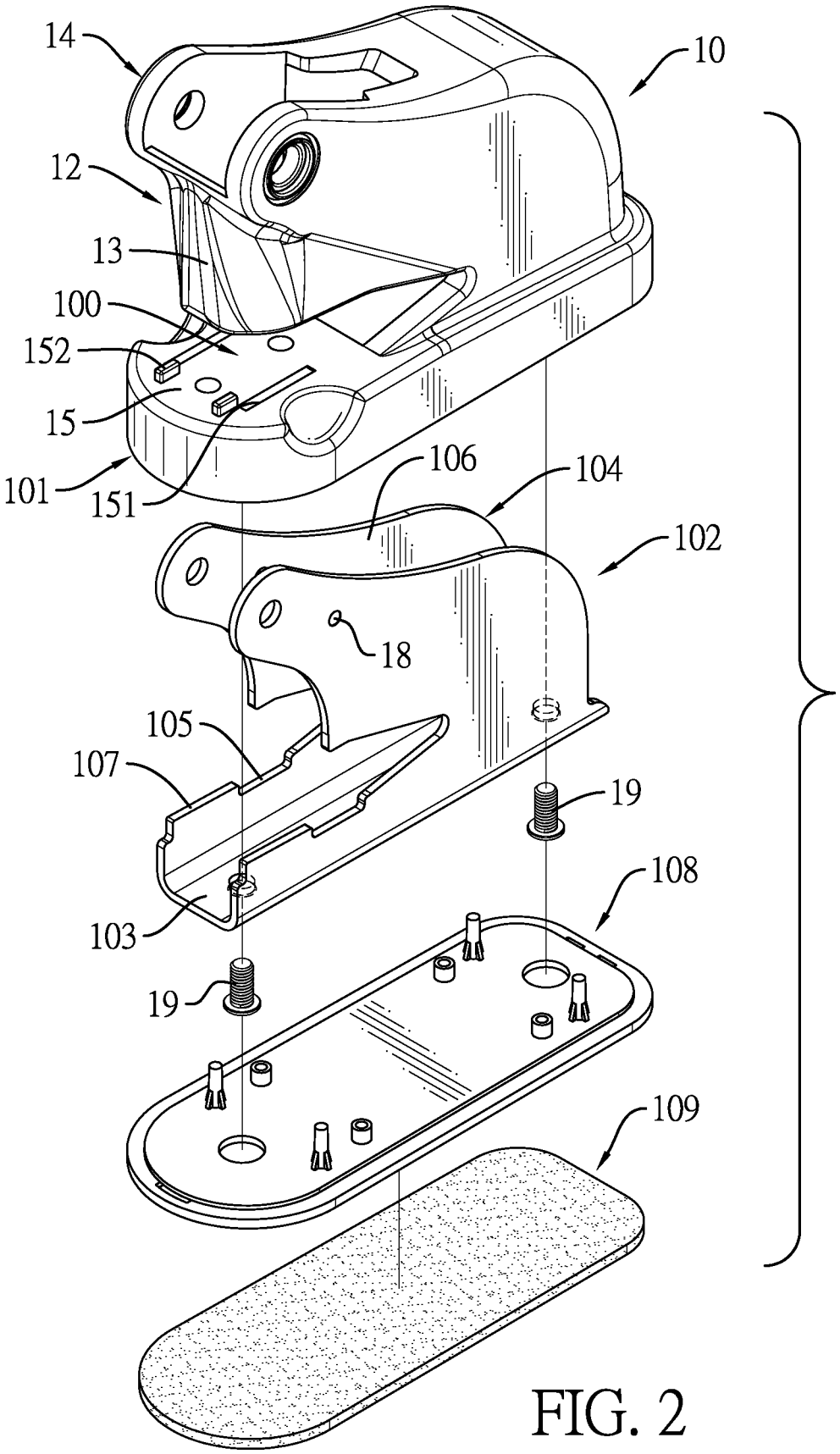
FIG. 2 is an exploded perspective view of a base of the embossing seal in FIG. 1.
Figure 3:
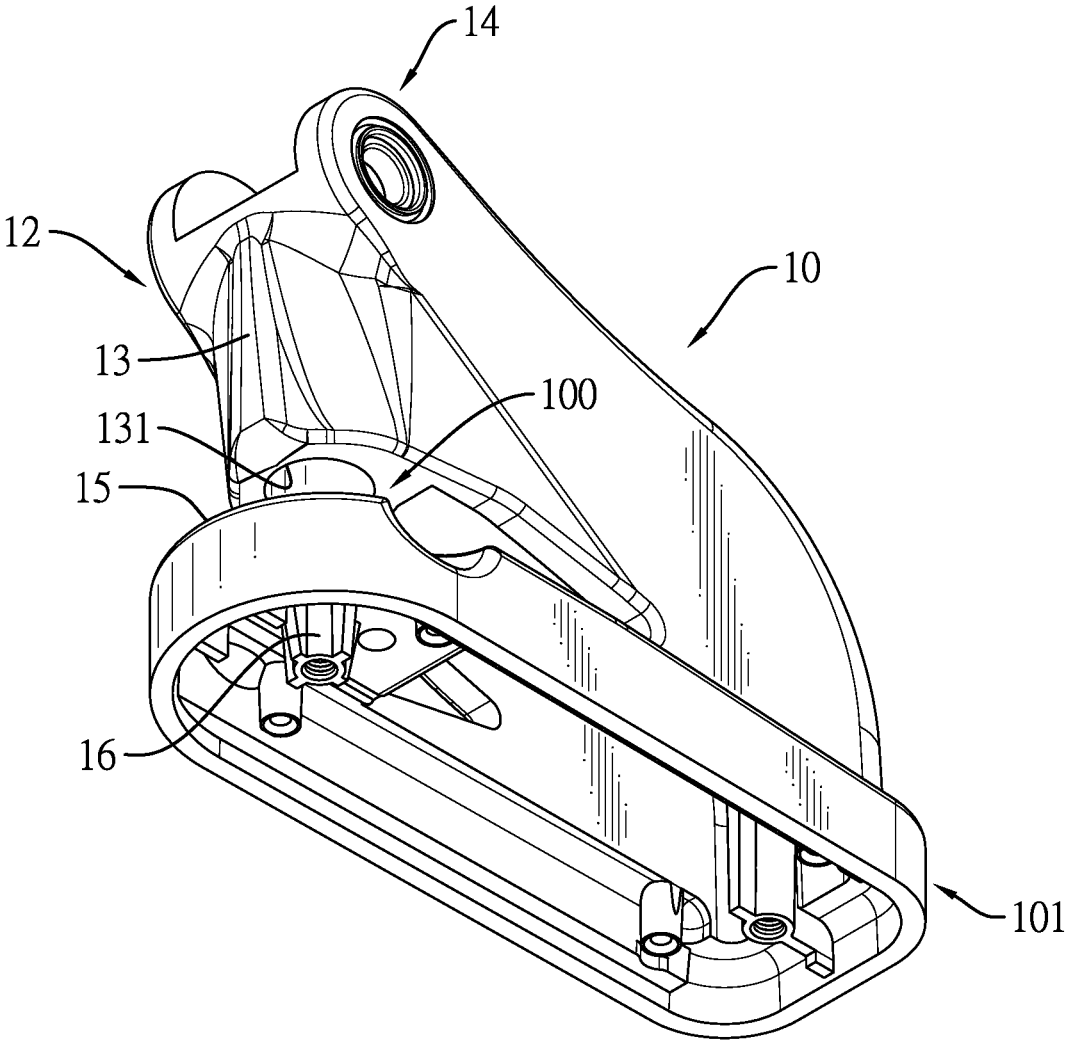
FIG. 3 is a perspective view of a shell of the base of the embossing seal in FIG. 2.
Figure 4:
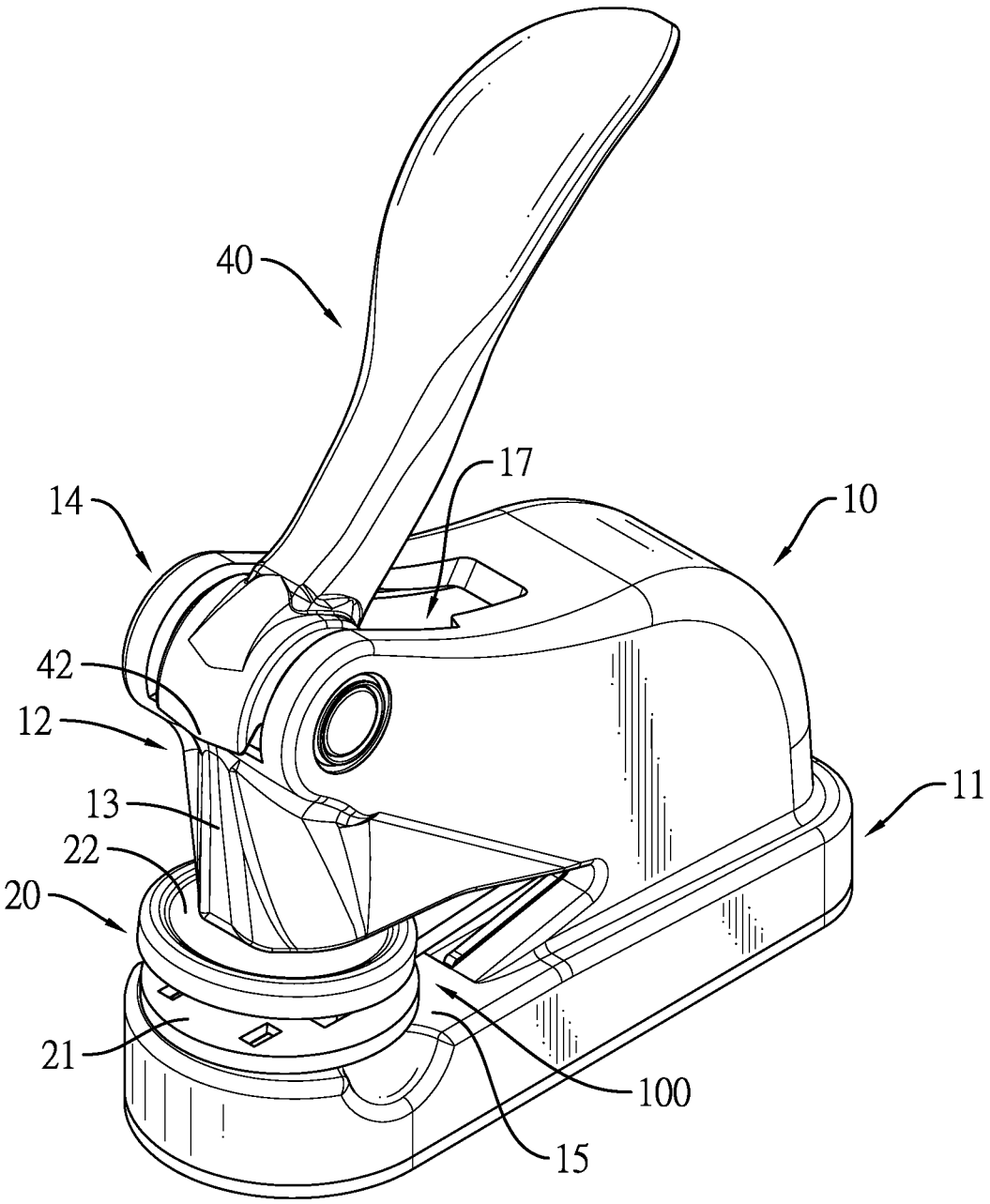
FIG. 4 is a perspective view of the embossing seal in FIG. 1.
Figure 5:
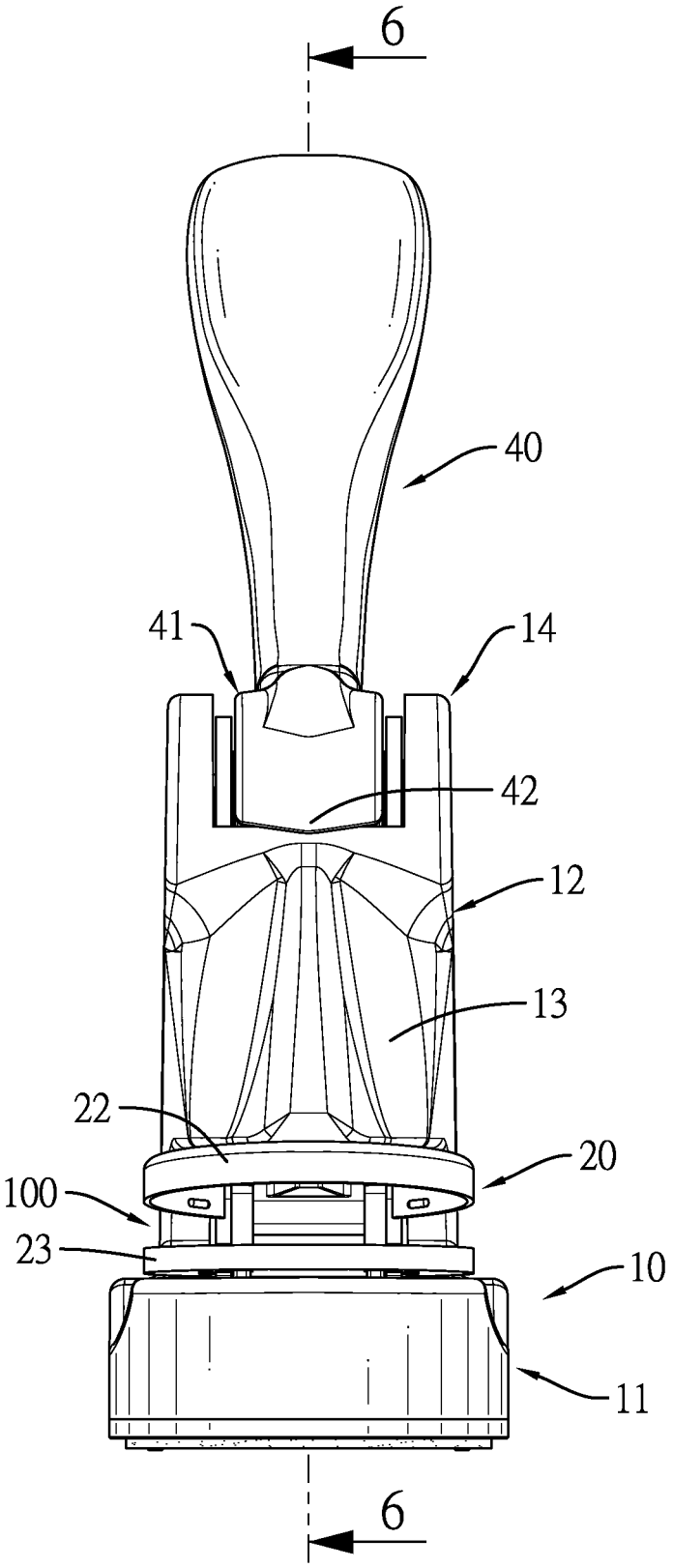
FIG. 5 is a front view of the embossing seal in FIG. 4.
Figure 8:
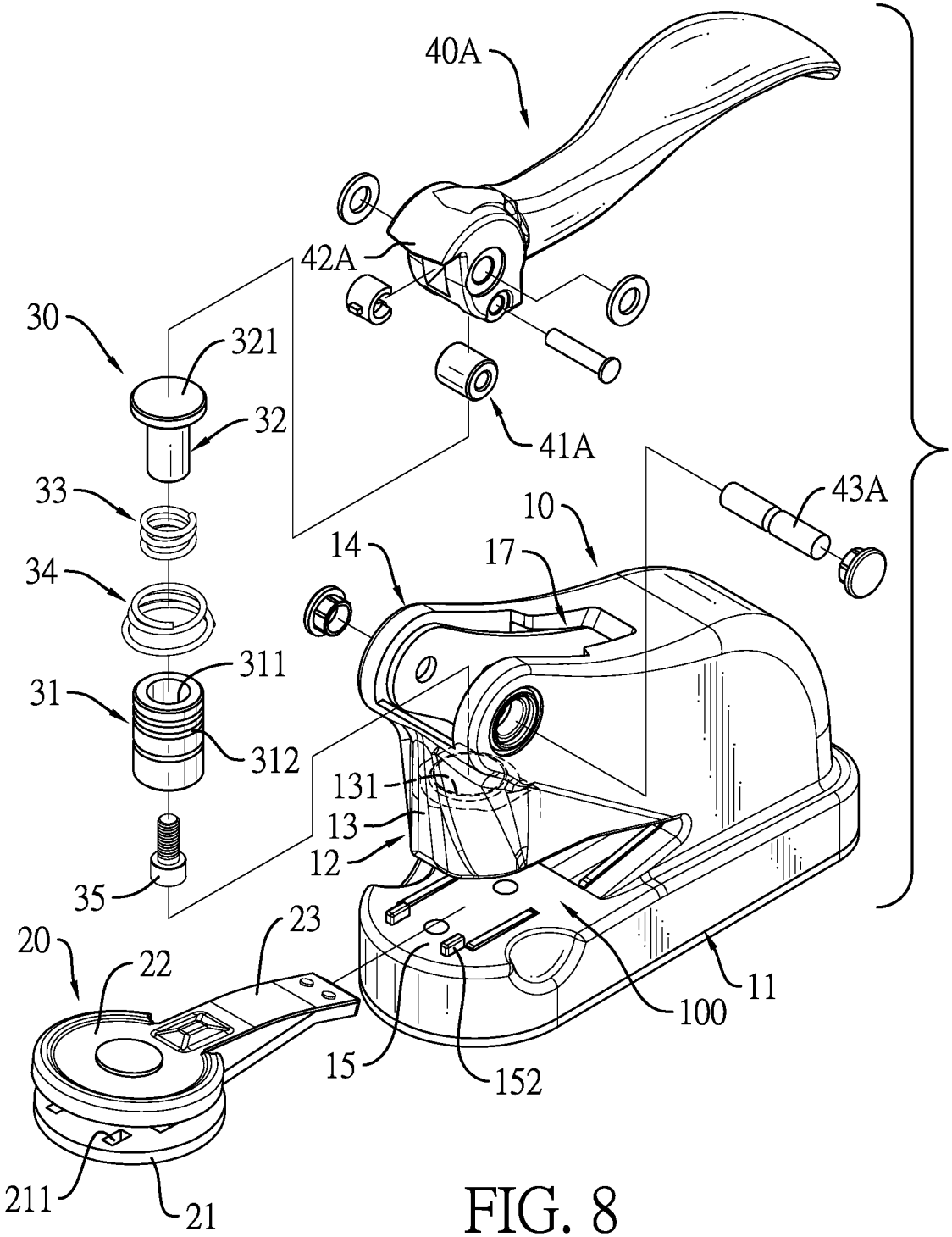
FIG. 8 is an exploded perspective view of a second embodiment of an embossing seal in accordance with the present invention.

With reference to FIGS. 1, 4, and 8, an embossing seal in accordance with the present invention comprises a base 10, a die assembly 20, a driven shaft assembly 30, and a pressing handle 40, 40A.

With reference to FIGS. 1, 6, 8, and 9, the base 10 has a carrying member 11, an embossing space 100, and an operating member 12. The carrying member 11 has a carrying platform 15 formed on the carrying member 11. The embossing space 100 is formed in the base 10 and is located above the carrying platform 15. The operating member 12 is formed on the carrying member 11 and has a shaft tube 13. The shaft tube 13 is formed on the operating member 12 and has a shaft hole 131. The shaft hole 131 of the shaft tube 13 is formed through the shaft tube 13, faces the carrying platform 15, and communicates with the embossing space 100 of the base 10. The embossing space 100 of the base 10 is located between the shaft tube 13 of the operating member 12 and the carrying member 11. The operating member 12 has a pivoting portion 14 and an opening 17. The pivoting portion 14 is formed on the operating member 12 and is located above the shaft tube 13. The opening 17 is formed in the operating member 12 at a position adjacent to the pivoting portion 14. The carrying member 11 has a bottom plate 103 disposed below the carrying platform 15. The carrying platform 15 has a bottom surface and a supporting rod 16. The supporting rod 16 is formed on the bottom surface of the carrying platform 15, is located below the shaft hole 131 of the shaft tube 13, and extends downwardly. A bottom end of the supporting rod 16 is connected to the bottom plate 103. The supporting rod 16 can assist in supporting the carrying platform 15. The carrying platform 15 has a top surface and two positioning protrusions 152. The two positioning protrusions 152 are formed on and upwardly protrude from the top surface of the carrying platform 15. The die assembly 20 is fixedly disposed on the carrying platform 15 by the two positioning protrusions 152.

With reference to FIGS. 1, 2, 6, 8, and 9, the base 10 has a shell 101 and a rigid seat 102 fixedly disposed in the shell 101 by multiple screws 19. The shell 101 is made of plastic. The shell 101 includes the carrying platform 15 and the supporting rod 16. The carrying platform 15 has two insertion holes 151 formed in the top surface of the carrying platform 15. The rigid seat 102 is made of a rigid material, such as iron or steel. The rigid seat 102 includes the bottom plate 103 and two side plates 104. The two side plates 104 are respectively formed on and upwardly extend from two side walls of the bottom plate 103. The two side plates 104 have two supporting portions 105 and two flanking portions 106. The two supporting portions 105 are respectively formed on the two side walls of the bottom plate 103, are located at two sides of the supporting rod 16, abut against the bottom surface of the carrying platform 15, and have two top edges and two retaining protrusions 107. The two retaining protrusions 107 are respectively formed in the two top edges of the two supporting portions 105 and are inserted respectively into the two insertion holes 151 of the carrying platform 15. The two retaining protrusions 107 can assist in supporting the carrying platform 15 and are respectively inserted into the two insertion holes 151 of the carrying platform 15 for positioning the rigid seat 102. The supporting rod 16 abuts against the bottom plate 103 of the rigid seat 102. One of the screws 19 is inserted through the bottom plate 103 and is screwed into the supporting rod 16.

With reference to FIGS. 2, 6, 8, and 9, the base 10 has a basing plate 108 and a skidproof pad 109. The basing plate 108 is disposed below the shell 101. The bottom plate 103 of the rigid seat 102 abuts against the basing plate 108. The skidproof pad 109 is disposed below the basing plate 108 for providing a skidproof function.

With reference to FIGS. 1, 4 to 6, 8, and 9, the die assembly 20 is disposed between the carrying member 11 of the base 10 and the operating member 12. The die assembly 20 has a lower die 21, an upper die 22, and an elastic part 23. The lower die 21 is disposed on the carrying platform 15, is located in the embossing space 100 of the base 10, and has two fixing holes 211 formed in the lower die 21. The two positioning protrusions 152 are respectively inserted into the two fixing holes 211 of the lower die 21. The upper die 22 is located in the embossing space 100 of the base 10, is disposed above the lower die 21, and faces the lower die 21. The elastic part 23 is connected to the lower die 21 and the upper die 22, and is inserted into the shell 101 of the base 10 and the rigid seat 102. The upper die 22 can move up and down relative to the lower die 21.

With reference to FIGS. 1, 6, 8, and 9, the driven shaft assembly 30 is movably disposed in the operating member 12 of the base 10. The driven shaft assembly 30 has a lower shaft 31, an upper shaft 32, a cushion spring 33, and a restoring spring 34.

With reference to FIGS. 1, 6, 8, and 9, the lower shaft 31 is disposed in the shaft hole 131 of the shaft tube 13, is moveable up and down relative to the base 10, and has a top end, a bottom end, and a central hole 311 formed through the lower shaft 31. A bottom end of the lower shaft 31 abuts a top surface of the upper die 22 of the die assembly 20. The upper shaft 32 is disposed in the central hole 311 of the lower shaft 31, is moveable up and down relative to the lower shaft 31, and has a top end and an active end portion. The top end of the upper shaft 32 protrudes out of the top end of the lower shaft 31. The active end portion 321 is formed on the top end of the upper shaft 32. The cushion spring 33 and the restoring spring 34 are coaxially disposed around the upper shaft 32. Two ends of the cushion spring 33 respectively abut against the active end portion 321 of the upper shaft 32 and the top end of the lower shaft 31. An inner diameter of the restoring spring 34 is larger than an outer diameter of the cushion spring 33. The restoring spring 34 is located around the cushion spring 33. Two ends of the restoring spring 34 respectively abut against the active end portion 321 of the upper shaft 32 and the top end of the shaft tube 13.

Figure 6:
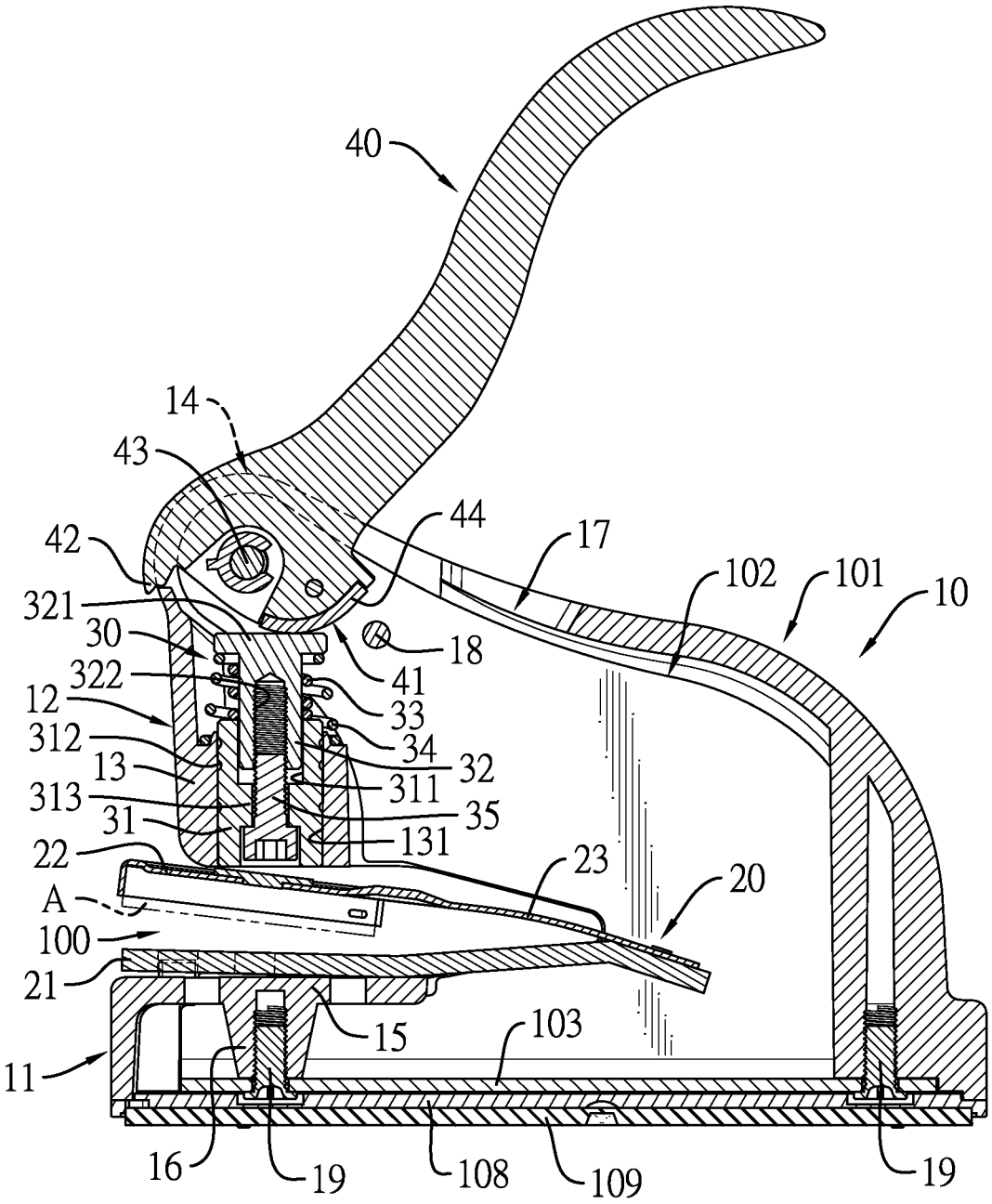
FIG. 6 is a cross sectional side view of the embossing seal along line 6-6 in FIG. 5.

With reference to FIGS. 1, 6, 8, and 9, the lower shaft 31 has an outer surface, an inner surface, at least one oil recess 312, and a limiting portion 313. The at least one oil recess 312 is formed in the outer surface of the lower shaft 31 and is filled with lubricant for reducing a frictional resistance between the lower shaft 31 and the base 10, and increasing a movement smoothness of the lower shaft 31. With reference to FIGS. 1 and 6, the upper shaft 32 has a bottom end and a threaded hole 322 formed in the bottom end of the upper shaft 32. The upper shaft 32 is inserted into the central hole 311 of the lower shaft 31, and a threaded element 35 of the driven shaft assembly 30 is screwed into the upper shaft 32. The limiting portion 313 is formed on the inner surface of the lower shaft 31. The threaded element 35 is inserted through the limiting portion 313 for limiting a movement distance of the upper shaft 32.

With reference to FIGS. 1, 4, 6, 8, and 9, a bottom end of the pressing handle 40, 40A is inserted into the opening 17 in the base 10. The pressing handle 40, 40A is pivotally disposed on the operating member 12 of the base 10 by a pivoting shaft 43, 43A. The pressing handle 40, 40A has a pushing portion 41, 41A and a stopping portion 42. The pushing portion 41, 41A is formed on the pressing handle 40,40A at a position adjacent to the bottom end of the pressing handle 40, 40A and abuts against the active end portion 321 of the upper shaft 32. The stopping portion 42 is formed on the pressing handle 40, 40A at a position adjacent to the pushing portion 41, 41A and is limited by a top portion of the operating member 12 for limiting a restoring rotating angle of the pressing handle 40,40A. The base 10 has a limiting rod 18. The limiting rod 18 is disposed in the operating member 12 and is located below the pushing portion 41, 41A for limiting a pressing rotating angle of the pressing handle 40, 40A.

Figure 9:
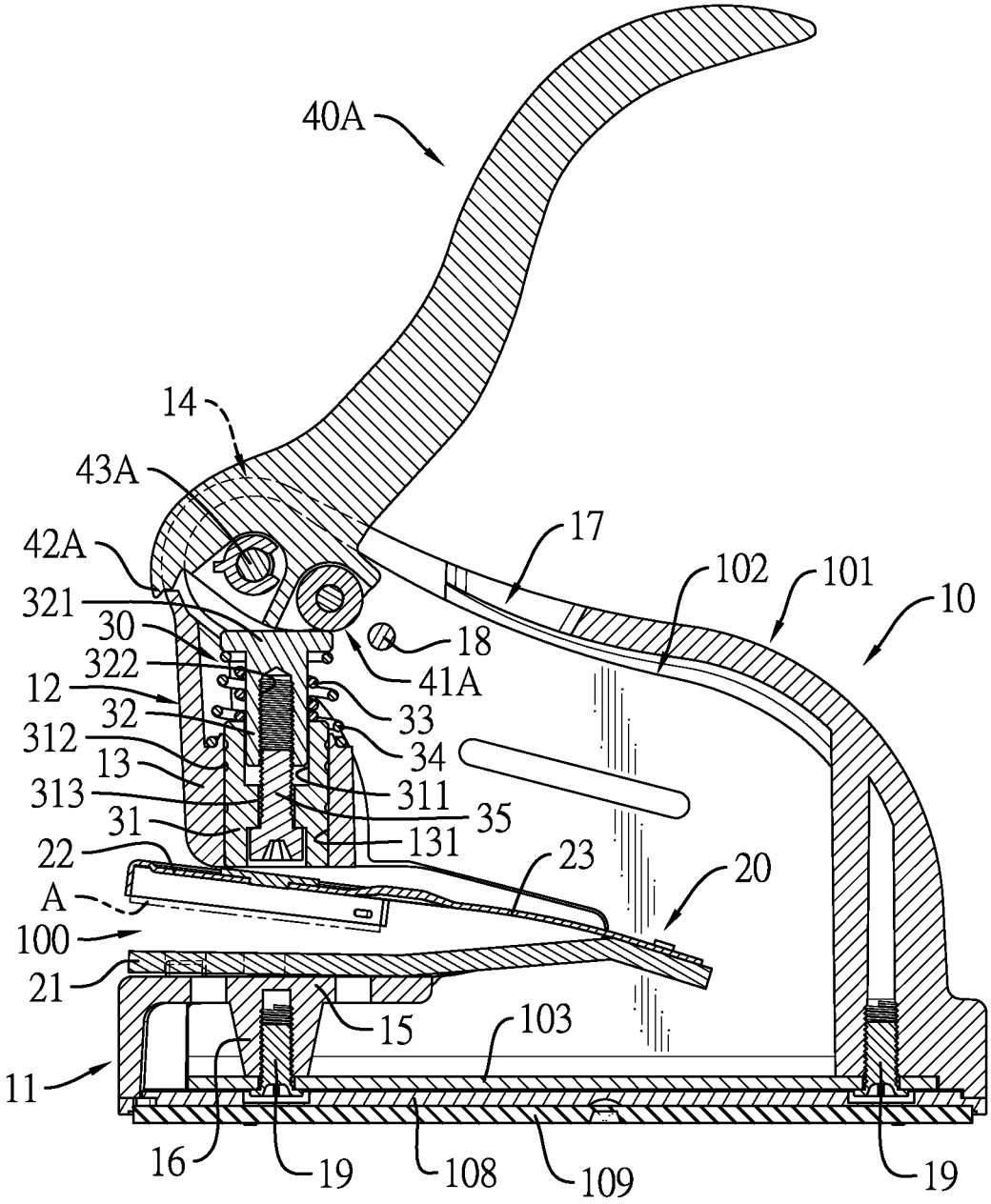
FIG. 9 is a cross sectional side view of the embossing seal in FIG. 8.
Figure 10:
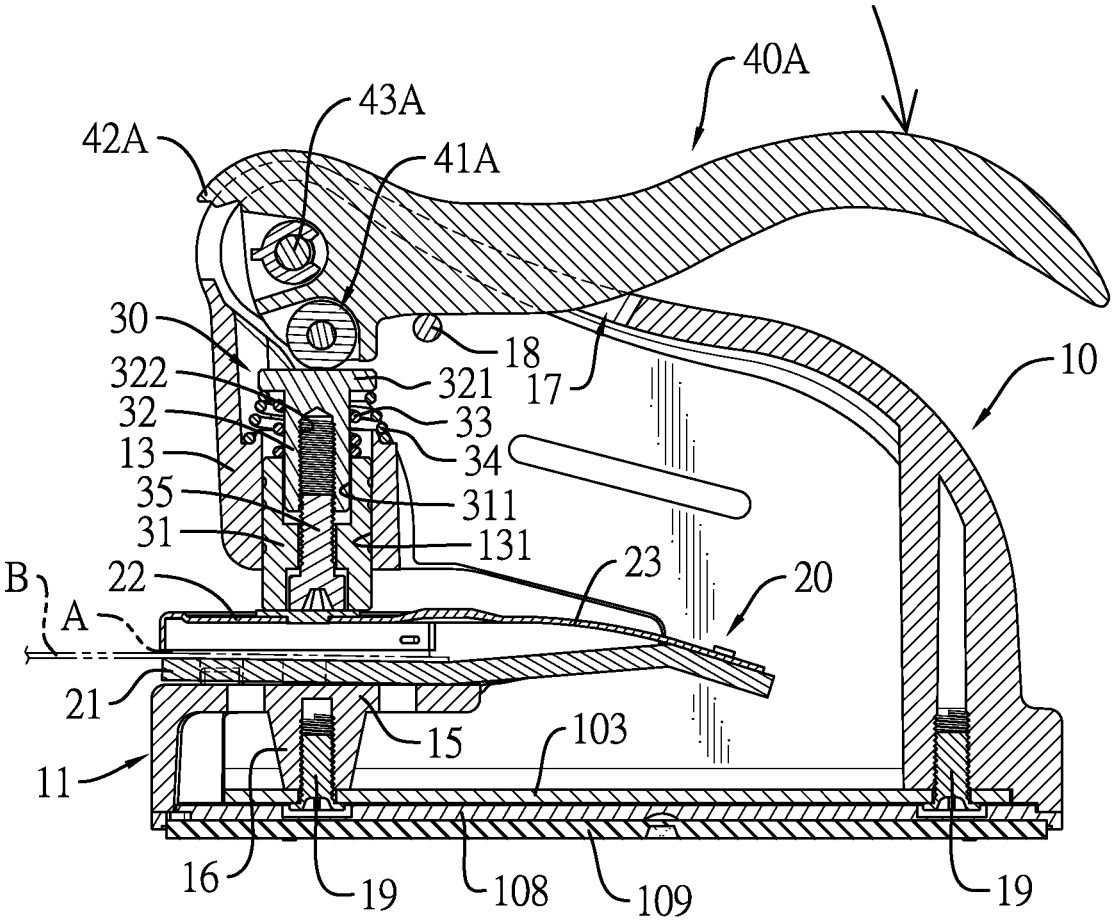
FIG. 10 is an operational and cross sectional side view of the embossing seal in FIG. 8.
Figure 11:
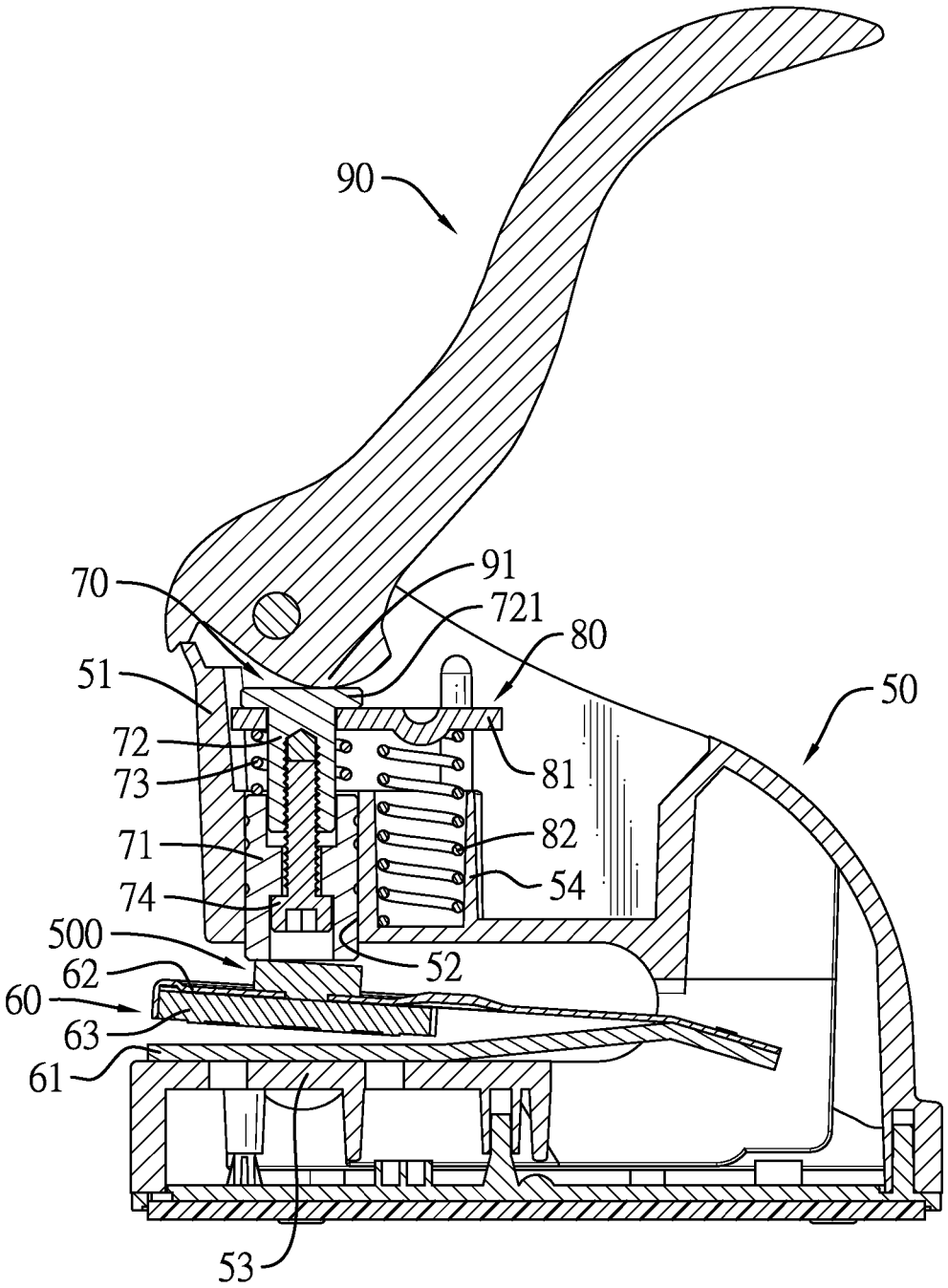
FIG. 11 PRIOR ART
FIG. 11 is a cross sectional side view of a conventional embossing seal in accordance with the prior art.
Figure 12:
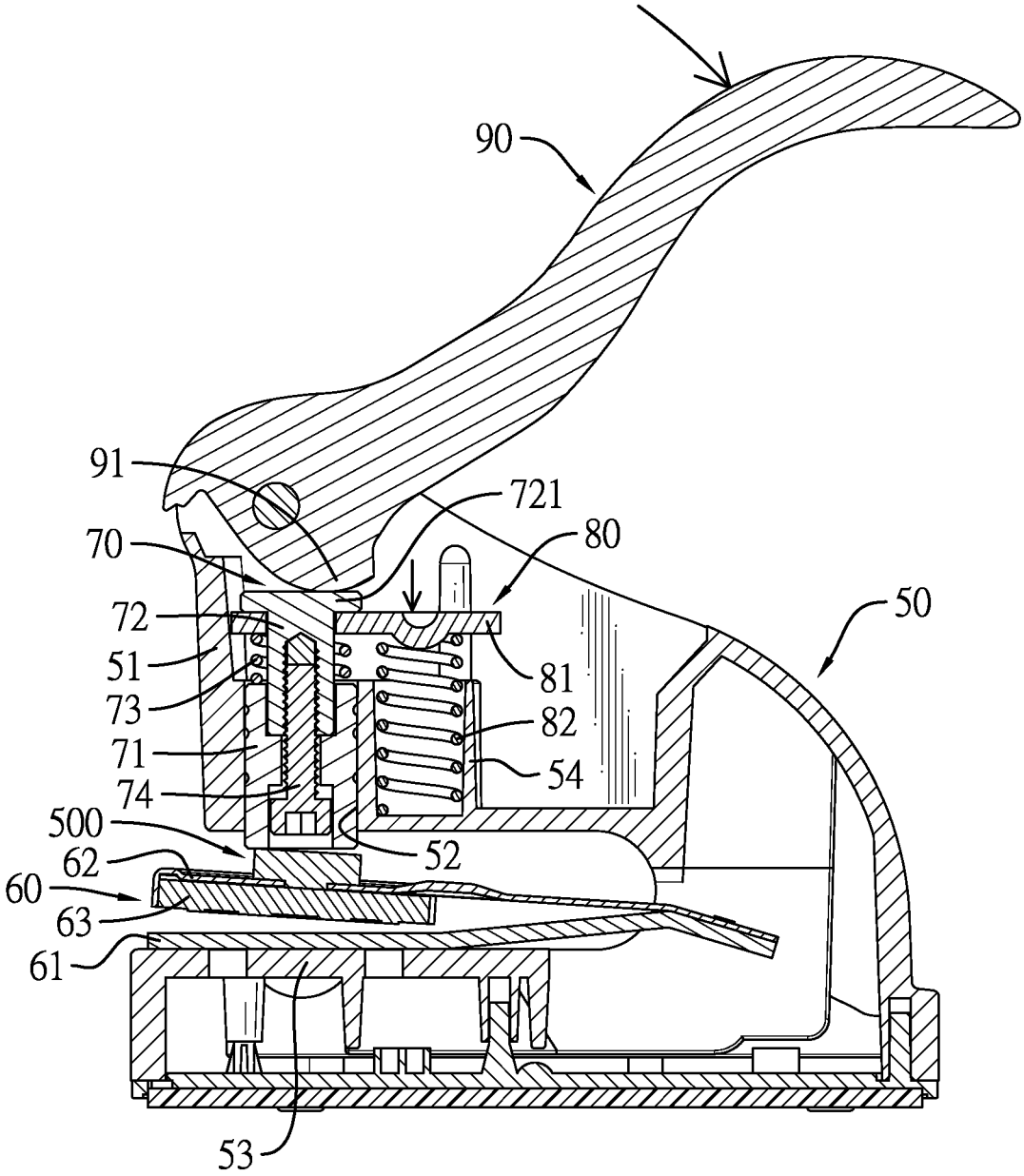
FIG. 12 PRIOR ART
FIG. 12 is an operational and cross sectional side view of the conventional embossing seal in FIG. 11.
Figure 13:
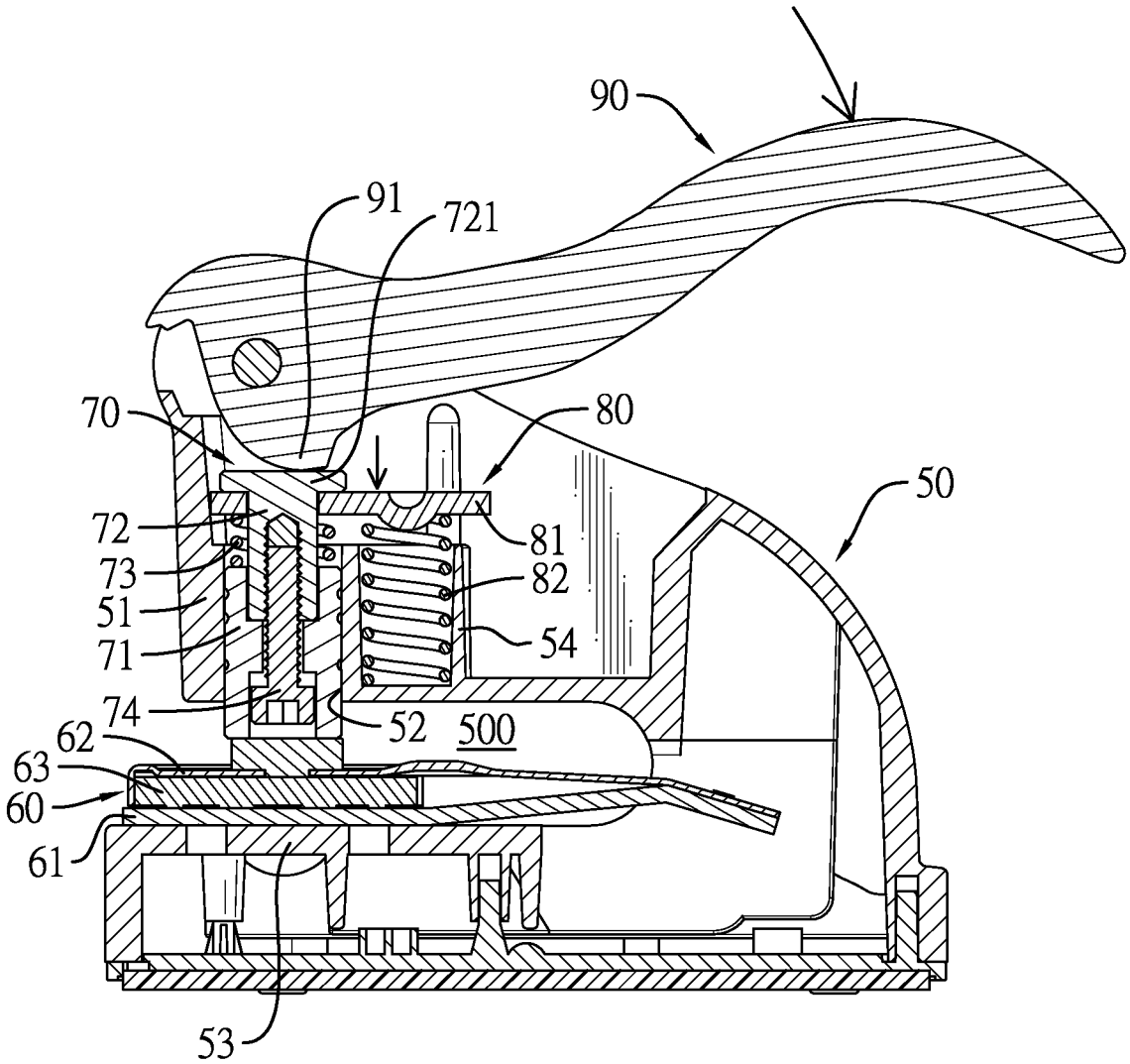
FIG. 13 PRIOR ART
FIG. 13 is another operational and cross sectional side view of the conventional embossing seal in FIG. 11.

With reference to FIGS. 1, 4, and 6, in a first embodiment of the embossing seal, the pushing portion 41 of the pressing handle 40 has a wear-resisting pad 44. The wear-resisting pad 44 is disposed on the pushing portion 41 and abuts the active end portion 321 of the upper shaft 32. Abrasion of the pushing portion 41 caused by the active end portion 321 of the upper shaft 32 can be reduced by the wear-resisting pad 44. With reference to FIGS. 8 and 9, the pushing portion 41A of the pressing handle 40A can be a rotatable roller and rotatably abuts the active end portion 321 of the upper shaft 32 for preventing the pushing portion 41A from deformation. The active end portion 321 of the upper shaft 32 is evenly forced by the pushing portion 41A.

Figure 7:
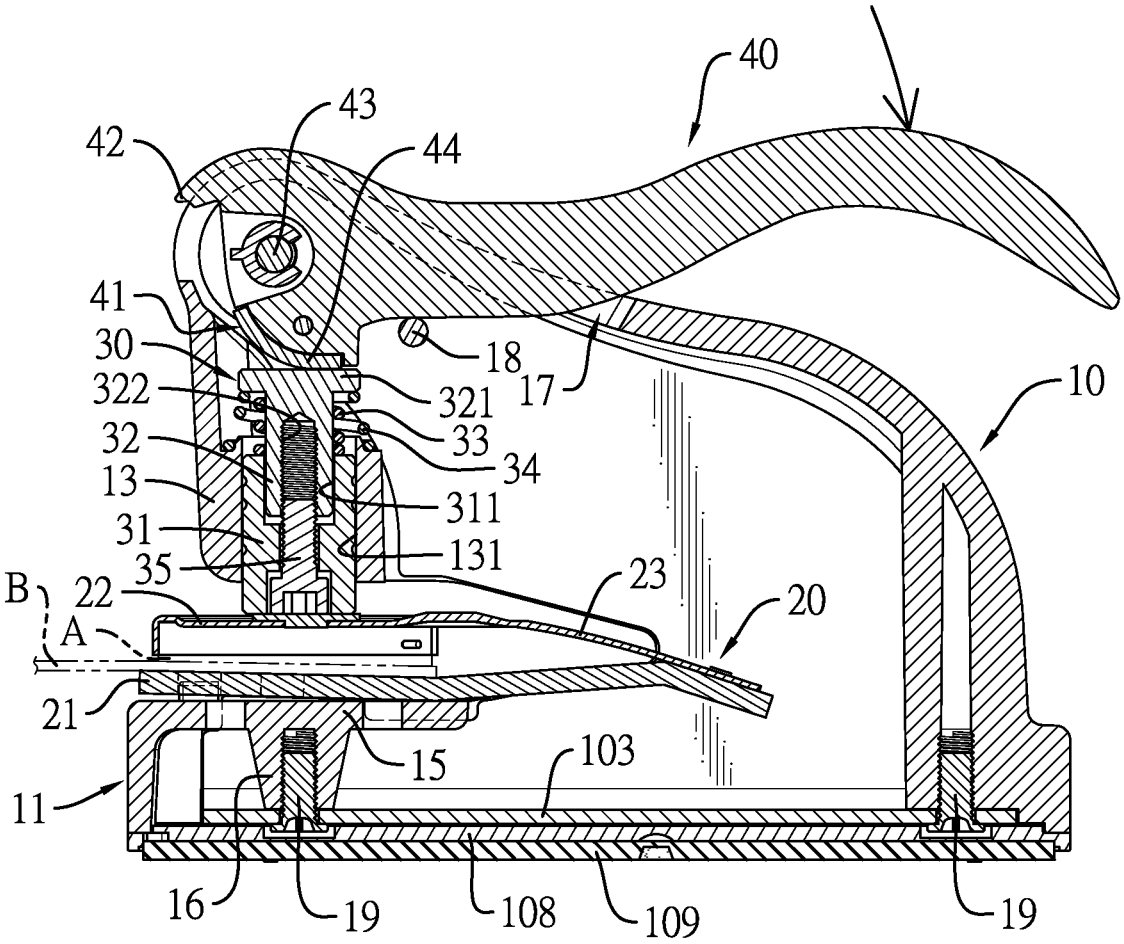
FIG. 7 is an operational and cross sectional side view of the embossing seal in FIG. 1.

With reference to FIGS. 1, 4 to 6, 8, and 9, a die block A is disposed on the upper die 22 and a pattern surface of the die block A faces the lower die 21. During embossing, a material B is mounted between the die block A and the lower die 21. With reference to FIGS. 6, 7, and 9, a user holds and turns the pressing handle 40, 40A. The pushing portion 41, 41A of the pressing handle 40, 40A provides a downward force to the driven shaft assembly 30, and the die block A is driven by the driven shaft assembly 30 to emboss with two embossing steps.

In a first embossing step, the pushing portion 41, 41A of the pressing handle 40, 40A provides the downward force to the active end portion 321 of the upper shaft 32. The upper shaft 32 drives the lower shaft 31 by the cushion spring 33. The upper die 22 is downwardly pressed by the lower shaft 31, and the die block A moves downwardly and abuts against the material B. Furthermore, the restoring spring 34 is pressed by the upper shaft 32 for accumulating elastic energy in the first embossing step. The upper shaft 32 drives the lower shaft 31 by the cushion spring 33, and then the upper shaft 32 and the lower shaft 31 move downwardly together for reducing the discomfort of the wrist and the elbow of the user, thereby improving both comfort and labor saving in operation of the embossing seal.

In a second embossing step, the downward force is increased and can be passed by the upper shaft 32, the cushion spring 33, and the lower shaft 31 for forcing on the upper die 22. The upper die 22 is pressed by the lower shaft 31. The supporting rod 16 is assisted in supporting the carrying platform 15. The die block A mounted on the upper die 22 forms clear embossed patterns on the material B. The cushion spring 33 located between the lower shaft 31 and the upper shaft 32 can provide cushion elasticity. A reaction force exerted on the wrist and the elbow of the user can be countervailed for reducing the discomfort during embossing operation.

When the embossing operation is finished, the pressing handle 40, 40A can be released. The upper shaft 32 is upwardly pushed by the restoring spring 34, and the pressing handle 40, 40A is rotated to restore. Simultaneously, the lower shaft 31 is restored by the threaded element 35 that is connected to the upper shaft 32. In the die assembly 20, the upper die 22 is driven by the elastic part 23 to restore.

What is claimed is:

1. An embossing seal comprising:

a base having a carrying member having a carrying platform formed on the carrying member;

an embossing space formed in the base and located above the carrying platform; and an operating member formed on the carrying member and having a shaft tube formed on the operating member, and having a shaft hole formed through the shaft tube and communicating with the embossing space of the base, wherein the embossing space of the base is located between the shaft tube and the carrying member;

a die assembly disposed in the base and having a lower die disposed on the carrying platform and located in the embossing space of the base;

an upper die located in the embossing space of the base and facing the lower die; and an elastic part connected to the lower die and the upper die;

a driven shaft assembly movably disposed in the operating member of the base and having a lower shaft disposed in the shaft hole of the shaft tube, being moveable up and down relative to the base, and having a top end and a central hole formed through the lower shaft;

an upper shaft disposed in the central hole of the lower shaft, being moveable up and down relative to the lower shaft, and having a top end of the upper shaft protruding out of the top end of the lower shaft; and an active end portion formed on the top end of the upper shaft;

a cushion spring disposed around the upper shaft and having two ends respectively abutting against the active end portion of the upper shaft and the top end of the lower shaft;

a restoring spring disposed around the upper shaft, located around the cushion spring, and having two ends respectively abutting against the active end portion of the upper shaft and the top end of the shaft tube, wherein the driven shaft assembly is able to drive the upper die to move relative to the lower die; and a pressing handle pivotally disposed on the operating member of the base, and having a bottom end being adjacent to the shaft tube;

a pushing portion formed adjacent to the bottom end of the pressing handle and abutting against the active end portion of the upper shaft.

2. The embossing seal as claimed in claim 1, wherein the carrying member has a bottom plate disposed below the carrying platform; and the carrying platform has a bottom surface and a supporting rod, the supporting rod is formed on the bottom surface of the carrying platform, is located below the shaft hole of the shaft tube, and extends downwardly to be connected to the bottom plate.

3. The embossing seal as claimed in claim 2, wherein the base has a shell including the carrying platform and having two insertion holes formed through the carrying platform; and a rigid seat fixedly disposed in the shell and including the bottom plate located below the carrying platform and having two side walls; and two side plates respectively formed on and upwardly extending from the two side walls of the bottom plate and having two supporting portions respectively formed on the two side walls of the bottom plate, located at two sides of the supporting rod, abutting against the bottom surface of the carrying platform, and having two top edges and two retaining protrusions, the two retaining protrusions respectively formed on the two top edges of the two supporting portions and inserted respectively into the two insertion holes of the carrying platform; and two flanking portions respectively formed on the two side walls of the bottom plate and located above the two supporting portions, wherein the supporting rod abuts against the bottom plate of the rigid seat, and a screw is inserted through the bottom plate and is screwed into the supporting rod.

4. The embossing seal as claimed in claim 3, wherein the base has a basing plate and a skidproof pad, the basing plate is disposed below the shell, the bottom plate of the rigid seat abuts against the basing plate, and the skidproof pad is disposed below the basing plate.

5. The embossing seal as claimed in claim 4, wherein the lower die has a bottom surface and two fixing holes formed on the bottom surface of the lower die; and the carrying platform has a top surface and two positioning protrusions, and the two positioning protrusions are formed on and upwardly protrude out of the top surface of the carrying platform, and are inserted into the two fixing holes of the lower die for fixing the lower die.

6. The embossing seal as claimed in claim 4, wherein the lower shaft has an outer surface;

an inner surface;

at least one oil recess formed on the outer surface of the lower shaft for filling lubricant; and a limiting portion formed on the inner surface of the lower shaft; and the upper shaft is inserted into the central hole of the lower shaft, and has a bottom end and a threaded hole formed on the bottom end of the upper shaft; and the driven shaft assembly has a threaded element inserted through the limiting portion and screwed into the threaded hole of the upper shaft.

7. The embossing seal as claimed in claim 3, wherein the lower die has a bottom surface and two fixing holes formed on the bottom surface of the lower die; and the carrying platform has a top surface and two positioning protrusions, and the two positioning protrusions are formed on and upwardly protrude out of the top surface of the carrying platform, and are inserted into the two fixing holes of the lower die for fixing the lower die.

8. The embossing seal as claimed in claim 3, wherein the lower shaft has an outer surface;

an inner surface;

at least one oil recess formed on the outer surface of the lower shaft for filling lubricant; and a limiting portion formed on the inner surface of the lower shaft; and the upper shaft is inserted into the central hole of the lower shaft, and has a bottom end and a threaded hole formed on the bottom end of the upper shaft; and the driven shaft assembly has a threaded element inserted through the limiting portion and screwed into the threaded hole of the upper shaft.

9. The embossing seal as claimed in claim 2, wherein the lower die has a bottom surface and two fixing holes formed on the bottom surface of the lower die; and the carrying platform has a top surface and two positioning protrusions, and the two positioning protrusions are formed on and upwardly protrude out of the top surface of the carrying platform, and are inserted into the two fixing holes of the lower die for fixing the lower die.

10. The embossing seal as claimed in claim 2, wherein the lower shaft has an outer surface;

an inner surface;

at least one oil recess formed on the outer surface of the lower shaft for filling lubricant; and a limiting portion formed on the inner surface of the lower shaft; and the upper shaft is inserted into the central hole of the lower shaft, and has a bottom end and a threaded hole formed on the bottom end of the upper shaft; and the driven shaft assembly has a threaded element inserted through the limiting portion and screwed into the threaded hole of the upper shaft.

11. The embossing seal as claimed in claim 2, wherein the pressing handle has a stopping portion formed on the pressing handle and adjacent to the pushing portion, and limited by a top portion of the operating member for limiting a restoring rotating angle of the pressing handle; and the base has a limiting rod disposed in the operating member, and located below the pushing portion for limiting a pressing rotating angle of the pressing handle.

12. The embossing seal as claimed in claim 11, wherein the pushing portion is a rotatable roller and is rotatably connected to the active end portion of the upper shaft.

13. The embossing seal as claimed in claim 11, wherein the pushing portion has a wear-resisting pad, and the wear-resisting pad is disposed on the pushing portion and is connected to the active end portion of the upper shaft.

14. The embossing seal as claimed in claim 11, wherein the lower shaft has an outer surface;

an inner surface;

at least one oil recess formed on the outer surface of the lower shaft for filling lubricant; and a limiting portion formed on the inner surface of the lower shaft; and the upper shaft is inserted into the central hole of the lower shaft, and has a bottom end and a threaded hole formed on the bottom end of the upper shaft; and the driven shaft assembly has a threaded element inserted through the limiting portion and screwed into the threaded hole of the upper shaft.

15. The embossing seal as claimed in claim 1, wherein the lower die has a bottom surface and two fixing holes formed in the bottom surface of the lower die; and the carrying platform has a top surface and two positioning protrusions, and the two positioning protrusions are formed on and upwardly protrude from the top surface of the carrying platform, and are inserted respectively into the two fixing holes of the lower die for fixing the lower die.

16. The embossing seal as claimed in claim 1, wherein the lower shaft has an outer surface;

an inner surface;

at least one oil recess formed in the outer surface of the lower shaft for filling lubricant; and a limiting portion formed on the inner surface of the lower shaft; and the upper shaft is inserted into the central hole of the lower shaft, and has a bottom end and a threaded hole formed in the bottom end of the upper shaft; and the driven shaft assembly has a threaded element inserted through the limiting portion and screwed into the threaded hole of the upper shaft.

17. The embossing seal as claimed in claim 1, wherein the pressing handle has a stopping portion formed on the pressing handle and adjacent to the pushing portion, and limited by a top portion of the operating member for limiting a restoring rotating angle of the pressing handle; and the base has a limiting rod disposed in the operating member, and located below the pushing portion for limiting a pressing rotating angle of the pressing handle.

18. The embossing seal as claimed in claim 17, wherein the pushing portion is a rotatable roller and rotatably abuts the active end portion of the upper shaft.

19. The embossing seal as claimed in claim 17, wherein the pushing portion has a wear-resisting pad, and the wear-resisting pad is disposed on the pushing portion and abuts the active end portion of the upper shaft.

20. The embossing seal as claimed in claim 17, wherein the lower shaft has an outer surface;

an inner surface;

at least one oil recess formed on the outer surface of the lower shaft for filling lubricant; and a limiting portion formed on the inner surface of the lower shaft; and the upper shaft is inserted into the central hole of the lower shaft, and has a bottom end and a threaded hole formed on the bottom end of the upper shaft; and the driven shaft assembly has a threaded element inserted through the limiting portion and screwed into the threaded hole of the upper shaft.

* * * * *